United States Patent [19]

Deaver et al.

[11] 4,192,401

[45] Mar. 11, 1980

[54] COMPLETE LOUVER FLOW MUFFLER

[75] Inventors: Don A. Deaver, Jackson; Dale E. Sterrett, Grass Lake, both of Mich.

[73] Assignee: Tenneco Inc., Deerfield, Ill.

[21] Appl. No.: 708,512

[22] Filed: Jul. 26, 1976

[51] Int. Cl.[2] ..... F01N 1/08; F01N 1/02

[52] U.S. Cl. ..... 181/266; 181/268; 181/272; 181/273; 181/275

[58] Field of Search ..... 181/57, 61, 54, 59, 181/48, 63, 53, 56

[56] References Cited

U.S. PATENT DOCUMENTS

| | | | |
|---|---|---|---|
| 2,661,073 | 12/1953 | Deremeo | 181/273 |
| 2,960,179 | 11/1960 | Bryant | 181/53 |
| 3,036,655 | 5/1962 | Powers | 181/61 |
| 3,283,847 | 11/1966 | Kerns et al. | 181/61 |
| 3,589,469 | 6/1971 | Hasui et al. | 181/54 |
| 3,741,336 | 6/1973 | Malash | 181/266 |
| 3,945,460 | 3/1976 | McMillan | 181/61 |
| 4,111,279 | 9/1978 | Sterrett | 181/273 |

*Primary Examiner*—L. T. Hix

*Assistant Examiner*—Benjamin R. Fuller

*Attorney, Agent, or Firm*—Harness, Dickey & Pierce

[57] ABSTRACT

A muffler for reducing the audible noise level of exhaust gases emitted by combustion engines has an inlet tube with a patch of louvers or perforations and is arranged so that all or substantially all the gas flowing through the muffler is forced through the patch into an expansion chamber from which it flows by either cross bleeding through a patch of louvers or perforations into an outlet tube or to a chamber opening into the inlet end of the outlet tube. A "splitter" partition may be used to control flow through the louvers and provide additional attenuation. An imperforate portion of the inlet tube is used as a driven tuning tube with a resonator chamber to form a Helmholtz low frequency attenuation system, the performance of which may be improved in some cases by use of an orifice in a wall of the resonator. Also disclosed is a muffler in which all the gas flows through a louver patch in the outlet tube and an imperforate part of the outlet tube is used as a part of an aspirating type Helmholtz system.

29 Claims, 15 Drawing Figures

COMPLETE LOUVER FLOW MUFFLER

BRIEF SUMMARY OF THE INVENTION

It is the purpose of this invention to provide an internal gas flow system for exhaust gas mufflers that may be used to remove a wide range of audible frequencies generated by the engine or gas flow itself and which is simpler, less costly, and lighter in weight than mufflers or more conventional design that are capable of equivalent performance.

Most of the disclosed forms of the invention use louvered (or perforated) inlet and outlet tubes in which all or substantially all the gas entering the muffler is forced to flow through the louvers (or perforations) in the inlet tube into an expansion chamber and then a portion or all of the gas flows from the expansion chamber through the louvers (or perforations) into the outlet tube, all gas not flowing through the outlet tube louvers (or perforations) passing from the expansion chamber into a turnaround chamber to enter the end of the outlet tube. A splitter partition may be used to provide some additional control of flow out of and into the louvers. This louver flow action is effective in attenuating sound in the intermediate and high audible frequency ranges (about 700–2000 Hz) and 2000–4000 Hz, respectively). A selected frequency in the lower range (about 40–700 Hz) may be attenuated in the muffler by using a portion of either of the louvered (or perforated) tubes as a tuning tube to act with a resonator chamber to form a Helmholtz resonator system tuned to diminish or remove the selected low frequency. Some broad banding of this low frequency attenuation may be achieved without adversely affecting the other sound attenuation mechanisms in the muffler by use of a small hole in a wall of the resonator chamber. The invention therefore provides means to meet both objective and subjective sound attenuation requirements for many different engine exhaust systems.

Other features and advantages of the invention will become apparent in connection with the complete description of the invention.

Figure 1:
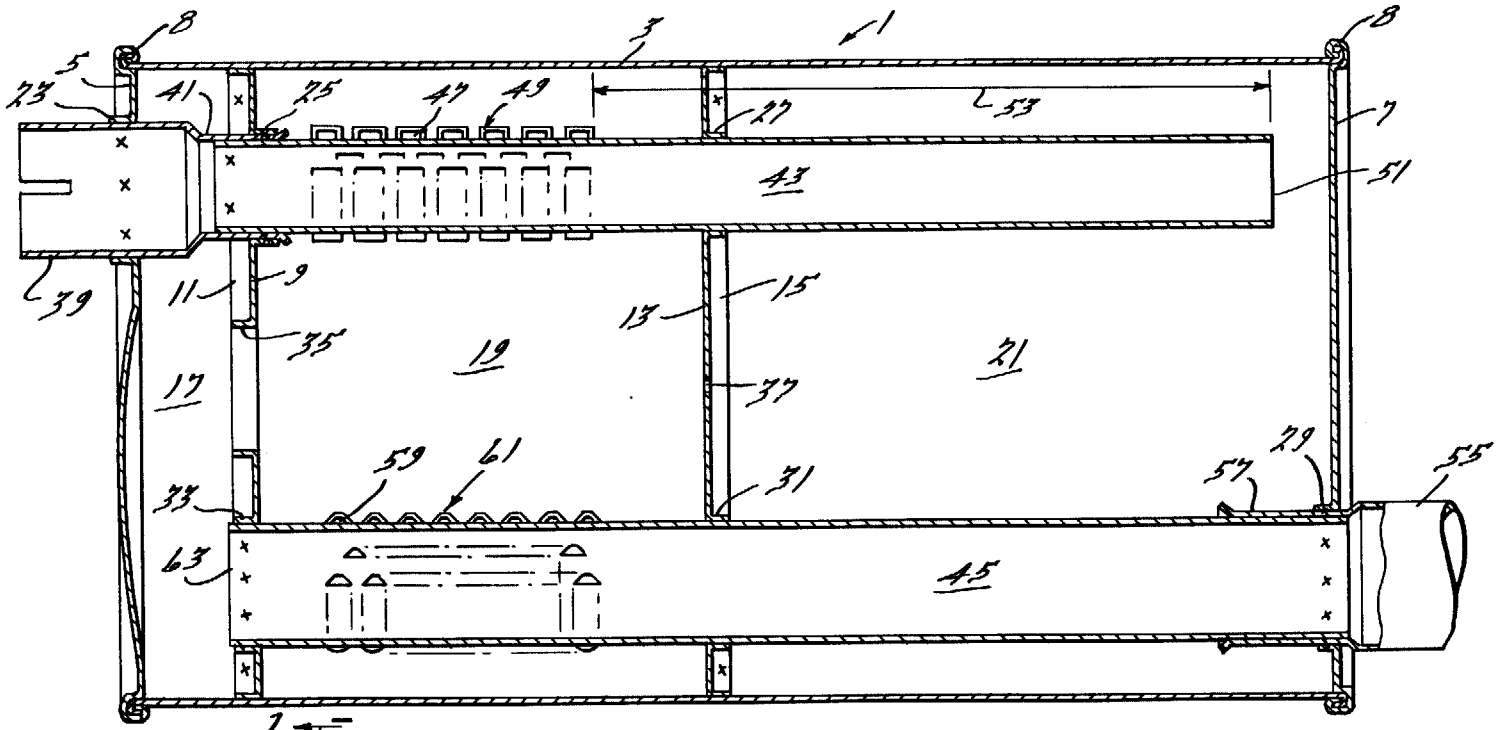
FIG. 1 is a cross section along the line 1—1 of FIG. 2 being essentially a longitudinal cross section through a muffler embodying the invention with certain parts rotated into the plane of the drawing.

In the drawing "x" indicates a spotweld or the equivalent.

DESCRIPTION OF THE INVENTION

Figure 2:
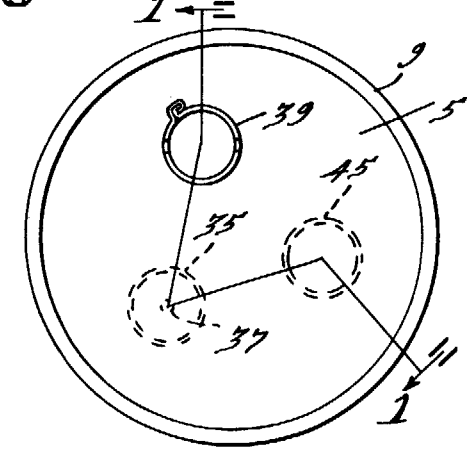
FIG. 2 is an end view taken from the left of FIG. 1.

Referring to FIGS. 1 and 2, the muffler 1 has a circular cylindrical outer shell 3 whose opposite ends are closed by an inlet header 5 and an outlet header 7 that are connected thereto in fluid tight interlock joints as seen at 8. Inside of the shell 3 is a transverse partition 9 with an axially extending circumferential flange 11 that fits the inside of the shell and is welded to it. A second transverse partition 13 is also inside of the shell 3 and has a circumferential axially extending flange 15 spotwelded to the shell. The two partitions 9 and 13 along with the end headers 5 and 7 divide the interior of the shell 3 into three chambers 17, 19, and 21.

The inlet header 5 has an outwardly extending collar or neck 23 and this is axially aligned with a somewhat smaller collar 25 in the partition 9 and another collar 27 in the partition 13 which is slightly smaller than the collar 25. The outlet header 7 has an inwardly extending neck or collar 29 which is axially aligned or concentric with a slightly smaller collar 31 in the partition 13 and a similar collar 33 in the partition 9. The partition 9 also has a flanged opening or collar 35 that interconnects chambers 17 and 19 to permit easy flow of gas from one to the other. The partition 13 has a very small orifice or opening 37 to interconnect the chamber 21 and the chamber 19 but it permits only a very small flow between the chambers. For example, the opening 37 may be about ½" diameter when the diameter of the shell 3 is about 6".

An inlet bushing 39 is supported in and spotwelded to the collar 23 in header 5 and has a reduced inner portion 41 that fits inside the collar 25 in partition 9 and is spotwelded to it. An inlet gas flow tube 43 has its upstream end supported in and spotwelded to the reduced diameter section 41 of the inlet bushing 23. The tube 43 extends through the collar 27, preferably not being welded to it but having a sliding fit in the collar to permit relative movement due to temperature caused dimensional changes. A portion of the tube 43 within the chamber 19 has circumferentially arranged rows of louvers 47 axially spaced from each other along the length of the tube forming a louver patch or section 49 which provide perforations or openings that enable gas to flow from the tube 43 into the chamber 19. The total area of opening provided by all of the lourvers in the louver patch 49 is no less than the cross sectional area of the inside of the tube 43 and preferably is about 110% of this area so as to present relatively low resistance to flow of all gas entering the muffler through the louver path 49 and into the expansion chamber 19.

With the exception of the very small hole 37, the partition 13 is imperforate so that chamber 21 is a closed resonator chamber whose only real inlet and outlet are through the open end 51 of the tube 43. The length 53 of the tube 43 from the downstream end of the louver patch 49 to the open downstream end 51 constitutes a tuning tube acts in conjunction with the chamber 21 to attenuate a preselected or predetermined low frequency. Normally, the tuning of a Helmholtz resonator is very sharp, that is, it is limited to a very narrow band of frequencies on either side of the one for which it is specifically tuned. A function of the hole 37 is to provide a slight broad banding effect to increase the range of frequencies for which some attenuation occurs beyond the specific frequency for which the Helmholtz system is tuned.

The Helmholtz formula is well known and is as follows:

$$F = \frac{V}{2\pi}\sqrt{\frac{\pi R^2}{Q(L + \frac{\pi R}{2})}}$$

where

F is the tuning frequency in cps;

V is the velocity of sound in feet per second;

Q is the volume of chamber 21 in cubic inches;

L is the length 53 in inches; and

R is the inside radius of the tube portion 53 in inches.

As pointed out in a copending application of Dale E. Sterrett, Ser. No. 708,513 filed of even date herewith, the acoustic engineer by use of this formula can design the muffler that has been so far described to attenuate a specific frequency in the lower range that needs to be silenced, e.g. about 40–700 cps. He knows this frequency and he knows the velocity of sound at the temperature with which he is concerned and acoustic measurements also will tell him the location of the pressure antinodes in the exhaust system for this particularly frequency. He is then able to select the length 53, the radius of the portion of tube 43 within the length 53, and the volume of the chamber 21 (or position of partition 13) in the proper proportions and relationships to each other to accommodate gas flow at a desired back pressure and to attenuate the desired troublesome frequency when the Helmholtz chamber is located at or near the pressure antinode for that frequency. Louver flow tuning as shown herein sometimes exhibits a sharp tuning effect in the fundamental and 2nd harmonic responses. To lessen this the small hole 37 in wall 13 may be used to permit a small amount of flow, no more than about 15% and preferably in the range of 5–15% of the total flow, from chamber 21 to chamber 19 and this flow interacts with flow in chamber 19 and through opening 35 to provide improved attenuation of the 2nd harmonic and smoothing of the fundamental response with a broad banding of up to about 10% of the frequency for which the Helmholtz system is tuned. The addition of hole 37 tends to raise the back pressure of the system, due, we believe, to increased radiation impedance from the additional inertance of this orifice, but this can be balanced or offset by adjusting (e.g. enlarging) collar 35 with which hole 37 is axially aligned as seen in FIG. 2.

An outlet bushing 55 has a reduced diameter section 57 that is supported in an spotwelded to the collar 29 in the outlet partition 7. The downstream end of an outlet tube 45 is supported in and spotwelded to the bushing section 57, the outlet tube 45, as is common, being somewhat larger than inlet tube 43. The other end of the outlet tube 45 is spotwelded in the collar 33, the tube preferably having a sliding fit in the collar 31 of the partition 13. The portion of the tube 45 in the resonator chamber 21 is, of course, imperforate so as to maintain the chamber 21 substantially closed except for the opening via the end 51 of tube 43. However, within the expansion chamber 19 the outlet tube 45 is provided with a series of louvers 59 forming a louver section or patch 61 in the tube 45. Each of the louvers 59 is preferably substantially smaller in open area than the louvers 47 and the total open are provided by all of the louvers 59 in the patch 61 is preferably about ⅓ of that provided by the louvers in the patch 49. As may be noted from the drawings, the shape of the opening in louvers 47 is preferably flat slotted or rectangular so as to obtain maximum area per louver whereas the shape of the louvers 59 is preferably rounded, e.g., approximately semi-circular or trapezoidal. The louvers 59 are, as is the usual practice, arranged in circular or circumferential rows extending around the entire circumference of the tube 45 and the rows are spaced axially along the length of the tube as indicated in the drawings. Adjacent circumferential rows may be staggered or offset in patch 61 as they are in the louver section 49 of the inlet tube 43.

With the arrangement and relative sizes and proportions shown, substantially all of the gas flowing into the muffler through the inlet bushing 39 will be forced to flow through the louver patch 49 into the expansion chamber 19, the exception being the relatively small amount of flow that can pass from chamber 21 through hole 37 into the chamber 19. Such small flow, however, does have a tendency to slightly raise the back pressure in the chamber 19 but this can be balanced by adjusting (enlarging) the size of the collar 35 which is preferably about the same diameter as that of the outlet tube 45. Gas leaves the chamber 19 in either of two ways. First, it may flow through collar 35 into the turnaround chamber 17 and into the inlet end 63 of the outlet tube 45. Second, it may flow through louvers 59 directly into tube 45. Inasmuch as the louver patch 61 has roughly ⅓ of the open area of the louver patch 49, most of the flow from chamber 19 will go through chamber 17 into the end 63 of the outlet tube. However, a substantial amount of flow will enter the tube 45 through the louvers 59.

In operation, the inlet bushing 39 may receive and be clamped to a conduit in the exhaust system of a combustion engine and the outlet bushing 55 may likewise be clamped to another conduit in the exhaust system or may itself serve as the outlet end or spout for the exhaust system. With the arrangement shown, the Helmholtz resonator system is of the "driven" type in that incoming gases from the bushing 39 flow directly down the tube 43 into the chamber 21. With driven tuning the unit 1 can be located at or near a pressure antinode for the preselected frequency to be attenuated that is close to the end of the exhaust system, for example, on the downstream side of the usual kick-up over the rear axle of the automobile. As will be seen hereinafter in connection with the muffler of FIGS. 13–15, the Helmholtz system may be of the type that has an aspirating tuner in which case the muffler is preferably located a substantial distance upstream from the end of the exhaust system.

The Helmholtz system functions to remove a particular low frequency sound while substantially the whole range intermediate and higher frequencies (700–4000 cps) are attenuated by gas flow through the louver patches and chambers 17 and 19. As indicated, substantially full flow of the gas through the muffler is forced by dead ending of the inlet tube in end chamber 21 to pass through the louver patch 49 into the expansion chamber 19. Also, as indicated, about ⅓ of the gas flowing through the muffler enters the outlet tube 45 through the louvers 59 and this flow is particularly effective in attenuating sound in the high range (2000–4000 Hz) and in producing acceptable subjective attenuation. In passing into and out of the louvers and chambers, substantial sound energy is removed due to the various changes in the cross sectional area through which the gas must flow and the actual neck lengths of the individual louvers. Some mixing and turbulence with accompanying sound energy loss occurs in expansion chamber 19 and end chamber 21 and then due to the restricted size of the collar 35, sound attenuation occurs as the gas passes from chamber 19 into chamber 17. In expanding in the chamber 17 attenuation again occurs and further attenuation occurs as the gas enters the restricted cross sectional area at the end 63 of the outlet tube 45. This action is especially effective in attenuating sound in the inermediate frequency range of about 700–2000 Hz. As the gas flows down the outlet tube 45 occasional pressure pulses may expand through the louvers 59 into the chamber 19 and this action will remove additional sound energy and add to the total attenuation.

Thus, it will be seen that the relatively simple structure of muffler 1 is capable of attenuation over a wide range of potentially audible sound. Adjustments in the particular and relative sizes of the louvers 47 and 59 as well as in the sizes of chambers 19 and 17 and collar 35 can be made, as compared with those illustrated, to obtain optimum results for a particular application. The muffler is effective in attenuating engine generated sound and, particularly because of the louver flow, is also effective in attenuating air rush noise generated by the gas flow itself. The fact that it can be placed at the end of the exhaust system and still attenuate a preselected low frequency is a marked advantage in its usefulness in attenuating air rush noise since that is the optimum location for removal of sound generated by gas flow itself.

Figure 3:
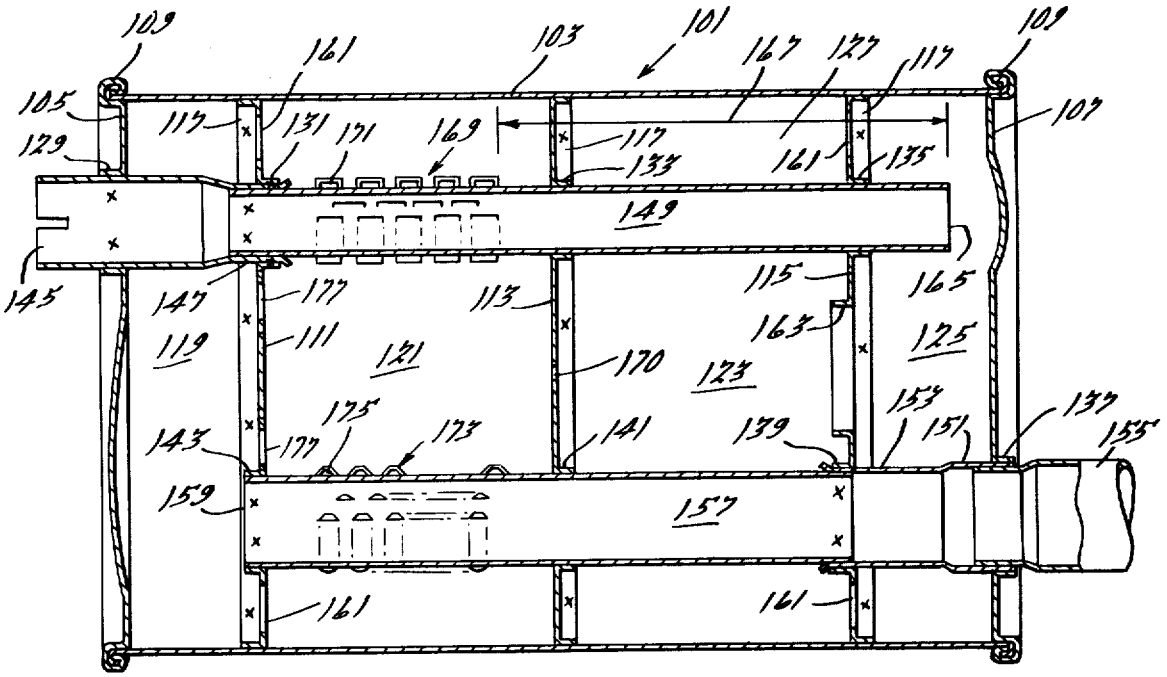
FIG. 3 is a longitudinal cross section along a midplane of a modified form of the invention as taken on line 3—3 of FIG. 4 and with parts broken away to show holes 177.
Figure 4:
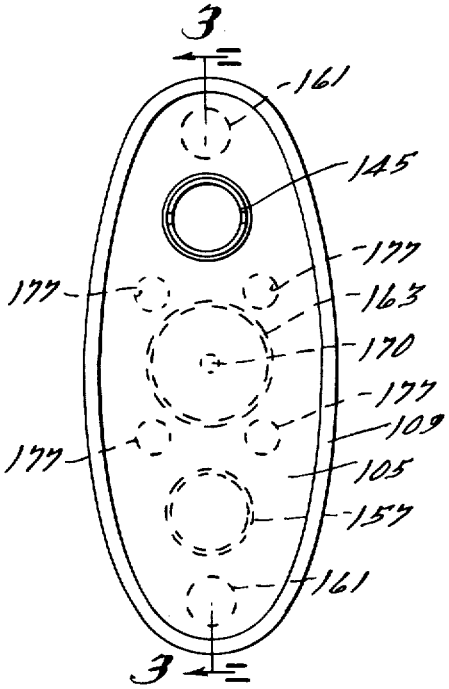
FIG. 4 is an end elevation taken from the left of FIG. 3.

Referring now to FIGS. 3 and 4, the muffler 101 has a tubular shell 103 of oval cross section which is closed at is inlet end by a header 105 and its outlet end by a header 107, the headers and the ends of the shell 103 being interconnected in a fluid tight joint by the interlocks shown at 109.

The interior of the muffler contains three transverse partitions 111, 113, and 115, each of which has an axially extending circumferential flange 117 that fits the inside of the shell 103 and is spot-welded to it. The three partitions subdivide the interior of the shell 103 into four chambers 119, 121, 123, and 125. As will be pointed out hereinafter, the two chambers 123 and 125 actually function as a single chamber and the primary purpose of the partition 115 is to furnish strength of the shell 103 and component parts of the muffler, i.e., it is a structural partition primarily for the purpose of strength. The two chambers 123 and 125 function together from the acoustic standpoint and for that purpose are also designated by the reference number 127.

The inlet header 105 has a neck or collar 129 that extends outwardly with respect to the interior of the sheel 103 and it is coaxially aligned with a smaller collar 131 in the partition 111 and stil smaller collars 133 and 135 in the partitions 113 and 115. The outlet header 107 has an outwardly extending collar 137 which is coaxially aligned with a slightly smaller collar 139 in the partition 115 and these in turn are coaxially aligned with slightly smaller collars 141 and 143 in partitions 111 and 113, respectively.

An inlet bushing 145 is supported in and spotwelded to collar 129 and has a reduced diameter inner portion 147 that fits in and is spotwelded to collar 131. An inlet gas flow tube 149 has its upstream end supported inside of the bushing section 147 and spotwelded to it. The tube extends through and is supported in the collars 133 and 135 and is preferably not spotwelded to them so that relative movement due to temperature created dimensional changes may be accommodated.

An outlet bushing 151 is supported in the collar 137 of outlet header 107 and has a reduced diameter portion 153 that is supported in collar 139 and spotwelded to it. A spout 155 serving as the outlet for the exhaust system is illustrated as fitting inside of the outlet bushing 151 indicating that this muffler 101 may be placed at the end of the exhaust system for reasons discussed in connection with the previous embodiment and as will become apparent hereinafter. An outlet tube 157 which is somewhat larger in diameter than the inlet tube 149, as is customary, has its downstream end supported in and spotwelded to the section 153 of the outlet bushing 151. The open inlet end 159 of the outlet tube 157 is supported in and spotwelded to the collar 143 in partition 111. The portion of outlet tube 157 and outlet bushing 151 within the chambers 123 and 125 (i.e., chamber 127) are imperforate.

The partition 115 has large openings 161 formed in the outer wall portions thereof as well as a large centered collared opening 163 so that there is relatively free communication between the chambers 123 and 125 that permits them to act together as a resonator chamber 127. The end 165 of the tube 149 opens into the chamber 125 and the length of tube 149 as indicated by the arrow 167 between the end of a louver patch 169 and the tube end 165 serves as a tuning tube that is properly related to the volume of chamber 127 in accordance with the Helmholtz formula discussed above to form a Helmholtz resonator system that will attenuate a preselected or predetermined low frequency sound. A small hole 170 in partition 113 (corresponding in function and purpose to hole 37) is axially concentric with opening 163 and connects the resonator chamber 127 to the chamber 121 to permit a very small amount of gas flow between the chambers. The interaction between hole 170 and holes 177 gives increased tuning effects as compared with an imperforate partition 113. As previously indicated, the outlet tube 157 and the bushing 151 are imperforate so that the most significant connection between the chamber 127 and the rest of the muffler from the standpoint of total gas flow is through the tuning tube section 167 of the inlet tube 149.

The louver patch 169 preferably corresponds to the patch 49 of the muffler 1 and therefore comprises a series of circumferential rows of individual louvers 171 extending around the periphery of the tube 149. These louvers preferably have rectangular openings and the total open area is preferably about 110% of the cross sectional area of the tube 149 in the louver patch section 169.

Similarly to muffler 1, the outlet tube 157 has a louver patch 173 formed of louvers 175 that are preferably semi-circular or trapezoidal in their open area so that individually and collectively their areas are significantly less than the louvers 171 and the louver patch 169.

The partition 111 has four openings through it as indicated at 177 as well as two larger openings corresponding in size to the openings 161 and axially aligned with them and accordingly given the same reference number. These openings serve the function of collar 35 but, in general, necessitate a longer flow path and a smaller cross section through which to flow for gas passing from chamber 121 to chamber 119 thereby absorbing more energy and producing somewhat greater attenuation. The combination of the two openings 161 and the four openings 177 plus the size or open area of the louver patch 173 in muffler 101 is such that approximately three fourths of the gas flow entering the muffler will pass from expansion chamber 121 into turn-around chamber 119 to enter the inlet end 159 of the outlet tube 157. This figure can, of course, be adjusted so as to obtain the desired objective and subjective sound levels desired.

In operation, gas enters the inlet bushing 145 and substantially all of it flows through the louver patch 169 into the chamber 121. Approximately one fourth of the gas will flow from chamber 121 through louvers 175 into the outlet tube 157 and the remainder will flow through partition 111 into the turn-around chamber 119 to flow out through the tube 157. The various cross sectional changes that the gas stream must pass through, as well as the changes in direction, do an effective job of attenuating intermediate and high frequency sounds while the Helmholtz system provided by the tuning tube length 167 and the resonator chamber 127 effectively attenuates a preselected low frequency sound. Broad banding of this low frequency is achieved to some degree, perhaps 10% or so, by virtue of the opening 170 in the partition 113.

Figure 5:
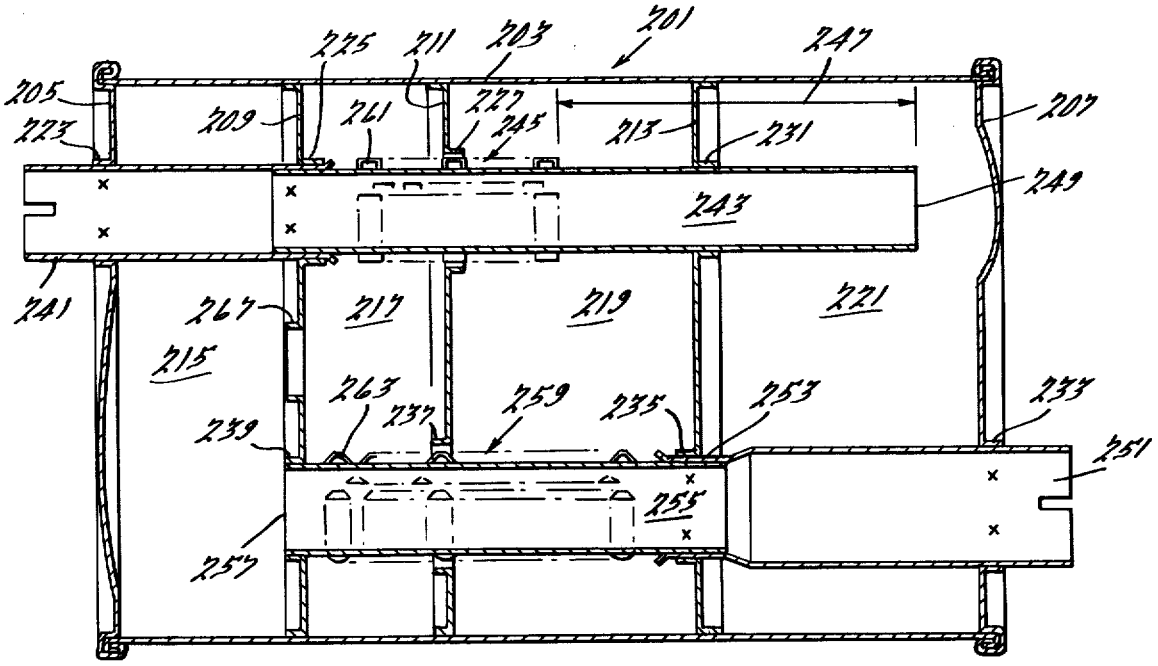
FIG. 5 is a longitudinal cross section along a midplane of a third form of the invention taken along line 5—5 of FIG. 6.
Figure 6:
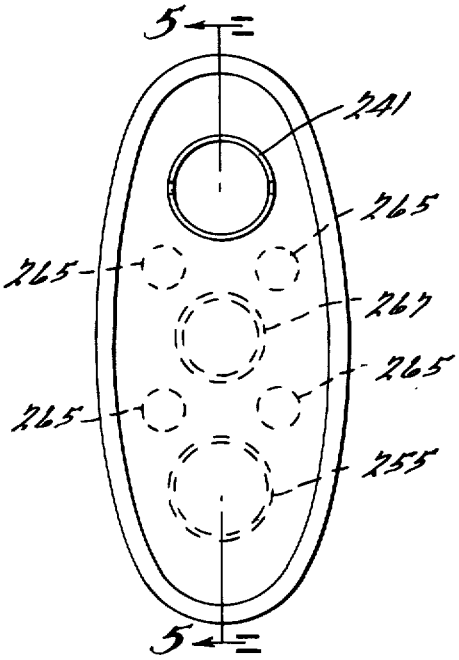
FIG. 6 is an end view taken from the left of FIG. 5.

Referring to FIGS. 5 and 6, the muffler 201 has an oval shell 203 which is closed at one end by an inlet header 205 and at the other end by an outlet header 207. Within the interior of the shell 203 are three partitions 209, 211, and 213 which are axially separated from each other and subdivide the interior of the shell into chambers 215, 217, 219, and 221.

The inlet header 205 has an outwardly extending collar 223 which is coaxial with a collar 225 in the partition 209 and with a somewhat larger collar 227 in the partition 211 and also with the somewhat smaller collar 231 in the partition 213. The outlet header 207 has an outwardly extending collar 233 which is coaxially aligned with a somewhat smaller collar 235 in the partition 213 and a collar 237 in partition 211, which is larger than collar 235, and a collar 239 which is in partition 209 and the smallest of the aligned collars.

An inlet bushing 241 is supported in and spotwelded to the collar 223 in the header 205 and is also supported in and spotwelded to collar 225 in partition 209. The upstream end of an inlet tube 243 is spotwelded in the bushing 241 and it has a louver patch 245 that extends through the collar 227 in partition 211 and an imperforate section that extends through and preferably is not spotwelded to the collar 231 in partition 213. The imperforate length of the tube 243, indicated by the arrow line 247 between the end of the louver patch 245 and the open end 249 of the tube 243, constitutes a tuning tube section that cooperates with end chamber 221 which functions as a resonator chamber. Its length and its diameter are related to the volume of the chamber 221 to form a Helmholtz resonator system designed in accordance with the formula and discussion set forth above to attenuate a predetermined relatively low frequency.

An outlet bushing 251 is supported in and spotwelded to the collar 233 in the header 207 and has a reduced diameter portion 253 that is supported in and spotwelded to the collar 235. The downstream end of an outlet tube 255 is mounted in and spotwelded to the section 253 of the outlet bushing. In this particular embodiment the outlet tube and inlet tube are preferably of the same diameter. The open upstream end 257 of the outlet tube is mounted in and spotwelded to the collar 239 in the partition 209. The outlet tube 255 has a louver patch 259 that extends through the collar 237 in partition 211 in a manner similar to the extension of the patch 245 through collar 227.

The louver patch 245 corresponds to the previously described louver patches in the inlet tube and is preferably formed of a series of circumferential rows of individual louvers 261 that have rectangular openings into both expansion chambers 217 and 219. The total area of openings of the louvers 261 in the patch 245 is at least about 100% and preferably about 110% of the cross sectional area of the inlet tube 243 so that a minimum back pressure is provided by the louvers to full flow of all gas entering the muffler out of the louver patch 245 into one or the other of the expansion chambers 217 and 219. The partition 211 is located approximately at the longitudinal midpoint of the louver patch 245 and serves as a flow splitter to divide approximately in half the flow out of the patch 245 into each of the chambers 217 and 219. The location of this "splitter" partition, as well as the others to be described later, can be varied along the length of the louver patch so that any desired percentage of the louver flow discharge can be baffled through the inner chamber, thus giving some flexibility of means to achieve a desired dba level.

The outlet tube 255 has a series of circumferential rings of louvers 263 which are, as in the previous embodiments, preferably of smaller cross sectional shape than louvers 261 and may be of semicircular, rounded, or trapezoidal configuration as previously indicated. However, in this unit the total length of the louver patch 259 is somewhat longer than that of 245 with the excess length being in the portion of outlet tube 255 that is in expansion chamber 219, the portion of louver patch 259 that is in expansion chamber 217 being of substantially the same length as that of louver patch 245 in chamber 217.

The splitter partition 211 has four relatively large openings 265 (FIG. 6) in them to permit flow between chambers 217 and 219. The collars 227 and 237 are preferably slightly larger than the O.D. of the respective louver patches (e.g. $\frac{1}{8}$" to $\frac{1}{4}$" diameter for tubes of approximately $1\frac{3}{4}$" to 2" dia.) so that some flow between chambers can pass through the clearance provided by the collars and thus help achieve a desired pressure balance in the muffler. However, the effect of the splitter partition and holes 265 is to force most of the gas entering expansion chamber 219 from louvers 261 to follow a longer path to reach end chamber 215, i.e., it must flow into expansion chamber 219, through holes 265 into expansion chamber 217, and through collar 267 in partition 209 to reach chamber 215. Collar 267 in the particular muffler illustrated, is preferably somewhat smaller than tubes 243 and 255. For example, the tubes may be 1.75" in outer diameter and the collar 267 1.50" inner diameter. The acoustic effect of the splitter partition arrangement is some additional dba attenuation which may be critical in enabling a particular muffler to meet dba code requirements. It has also given some reduction in low end 2nd harmonic and improvement in subjective sound levels.

The partition 213 is imperforate as is the outlet bushing 251 which is within the chamber 221 so that the only inlet and outlet to chamber 221 are provided by the tube 243. Thus, as in previous embodiments and the previous more extended discussion, the length 247 of the inlet tube 243 between the downstream end of the louver patch 245 and the end 249 of the tube constitutes a tuning tube and the chamber 221 constitutes a resonator volume and these are interrelated and interdependent in accordance with the Helmholtz formula to attenuate a desired low frequency.

In operation, gas entering the muffler through bushing 241 will flow into the inlet tube 243 and the preselected low frequency will be attenuated by the driven Helmholtz tuner system consisting of the tube section 247 and the chamber 221. All gas entering the muffler must reach the outlet tube by passing through the louver patch 245 to enter either chamber 217 or 219. The gas which enters chamber 217 encounters resistance to direct flow across to the louvers 263 because of their smaller cross sectional size and accordingly some of it will flow through the opening 267 into the chamber 215 when it can turn around and enter the outlet tube through its open end 257. Gas can also leave the inlet tube 243 through the louvers that are in chamber 219 and since there are a greater number of louvers 263 in this chamber, some of the gas can flow across the chamber and directly into the outlet tube 255. The holes 265 between chambers 217 and 219 and to some extent the clearance space inside collars 227 and 237 provide means to maintain a balanced pressure and flow condition within the muffler to minimize back pressure and enable the gas to flow toward the outlet tube 255 along the path presenting the least resistance.

As discussed in more detail in connection with muffler 1, the various acoustic features of the muffler 201 enable it to attenuate engine generated and gas flow generated sound over a wide range of frequencies and the addition of the splitter partition adds to the available attenuation and the increased length of patch 259 to some back pressure reduction and increased attenuation in the higher frequency range.

Figure 7:
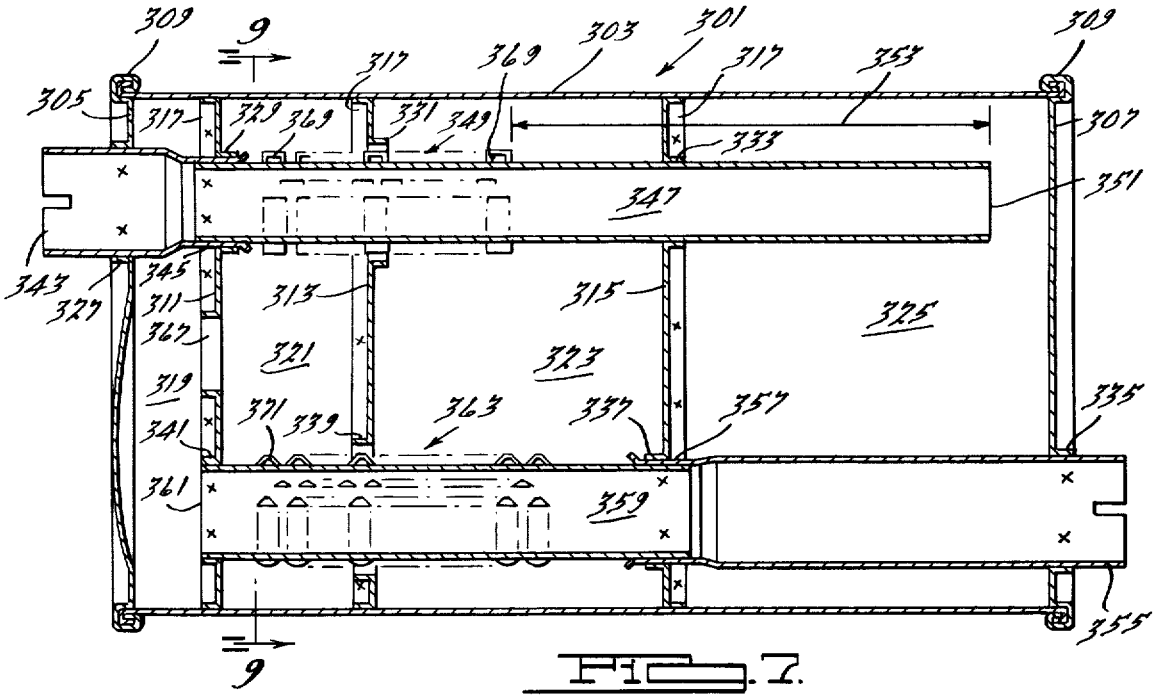
FIG. 7 is a cross section along the line 7—7 of FIG. 8 showing another form of the invention and being substantially a longitudinal cross section with parts rotated into the plane of the drawing to facilitate illustration.
Figure 8:
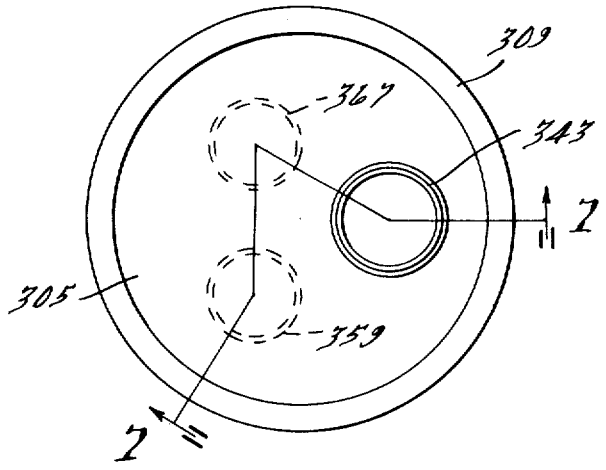
FIG. 8 is an end elevation taken from the left of FIG. 7.
Figure 9:
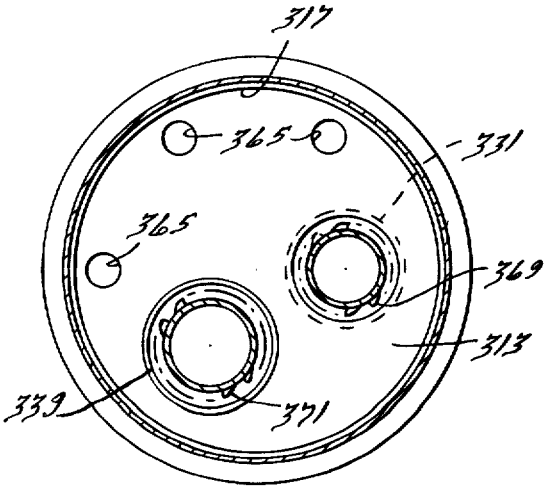
FIG. 9 is a cross section along the line 9—9 of FIG. 7.

Referring now to FIGS. 7–9, the muffler 301 is very similar to the muffler 201 but is of a round cross section as seen in FIGS. 8 and 9. It has a round tubular shell 303 which is closed at its inlet end by a header 305 and at its outlet end by a header 307, the header being connected to the shell 303 in fluid tight joints as shown by the interlocks 309.

Within the shell are axially spaced transverse partitions 311, 313, and 315 of round cross section and having circumferential flanges 317 that are spotwelded to the inside of the shell 303. The partitions subdivide the interior of the shell 303 into four chambers 319, 321, 323, and 325.

The inlet header 305 has an outwardly extending collar 327 which is coaxial with a smaller collar 329 on the partition 311 and with a somewhat larger collar 331 in the partition 313 and with a still smaller collar 333 on the partition 315. The outlet header 307 has an outwardly extending collar 335 which is coaxial with a somewhat smaller collar 337 in the partition 315, with a larger collar 339 in partition 313, and also with a smaller collar 341 on the partition 311.

An inlet bushing 343 is supported in and spotwelded to the collar 327 in the header 305 and has a reduced diameter portion 345 that is supported in and spotwelded to the collar 329 in partition 311. The inlet end of an inlet tube 347 is supported in and spotwelded to the section 345 of the bushing 343 and it has a louver patch 349 that extends through the collar 331. The inlet tube 347 has an open end 351 and an imperforate portion designated by the arrowed line 353 that extends between the end of the louver patch 349 and the tube end 351.

As in the previous forms of the invention, the section 353 of the inlet tube 347 acts with the end chamber 325 to form a Helmholtz resonator system, that is, the volume of end chamber 325, the diameter of the section 353 of the inlet tube, and the length of that section are all interrelated and interdependent in accordance with the Helmholtz formula to attenuate a preselected relatively low frequency as discussed above in more detail.

An outlet bushing 355 is supported in and spotwelded to the collar 335 of header 307 and has a reduced diameter portion 357 that is supported in and spotwelded to the collar 337 in partition 315. The downstream end of an outlet tube 359 is supported in and spotwelded to the section 357 and its open upstream end 361 is supported in and spot-welded to the collar 341 of the partition 311. The outlet tube 359 has a louver patch 363 that extends through the collar 339.

The partition 313 has three openings 365 near its outer circumference which permit gas flow between expansion chambers 321 and 323. As in muffler 201, the collars 331 and 339 are slightly larger than the outer diameter of the respective louver patches and some flow can take place through the clearances. A collared opening 367 in the partition 311 permits flow between expansion chamber 321 and end chamber 319. Collar 367 is preferably the same cross sectional area as inlet tube 347 which in this case is somewhat smaller than that of the outlet tube 359. End chamber 325 is entirely closed except for the open end 351 of the tube 345 so that it can serve as a resonator chamber in the Helmholtz system and force gas to flow out of louver patch 349 into expansion chambers 321 and 323.

The louver patch 349 has circumferential rows of louvers 369 with openings that in the aggregate are 100% and preferably about 110% of the cross sectional area of the tube 347. In the louver patch 363 the individual louvers 371 have smaller cross sectional openings than the louvers 369, as in the previous embodiments, and they are also arranged in circumferential rings or rows axially separated from each other along a part of the length of the tube. Approximately the same number of louvers 369 and louvers 371 are within the chamber 321, while in chamber 323 there are more of the louvers 371 (patch 363) than louvers 369 (patch 349) due to longer length of patch 363.

As in the preceding embodiment of FIGS. 5–6, the partition 313 is substantially at the midpoint of louver patch 349 and divides the outflow from it about equally between chambers 321 and 323. While some of the gas can cross bleed in chamber 323 to smaller louvers 371 or pass through collars 331 and 339, most of it will follow a relatively long path through holes 365 into expansion chamber 321 and then through collar 367 into end chamber 319. All gas entering into chamber 321 can cross bleed into smaller louvers 371 but most will flow into end chamber 319 and enter open end 361 of outlet tube 359.

Thus, muffler 301, like muffler 201, embodies acoustic mechanisms effective over a wide spectrum of frequencies to provide acceptable objective and subjective attenuation of engine generated noise and also of air rush noise if it is positioned adjacent the end of the exhaust system. The muffler 301, for example, has more dba control than muffler 1 because of the splitter partition and louver arrangement. However, in certain catalytic exhaust systems, for example, where the converter does some sound attenuation the muffler 1 may be adequate to silence the exhaust system. On the other hand, if more attenuation is needed, the muffler 301 can be used.

Figure 10:
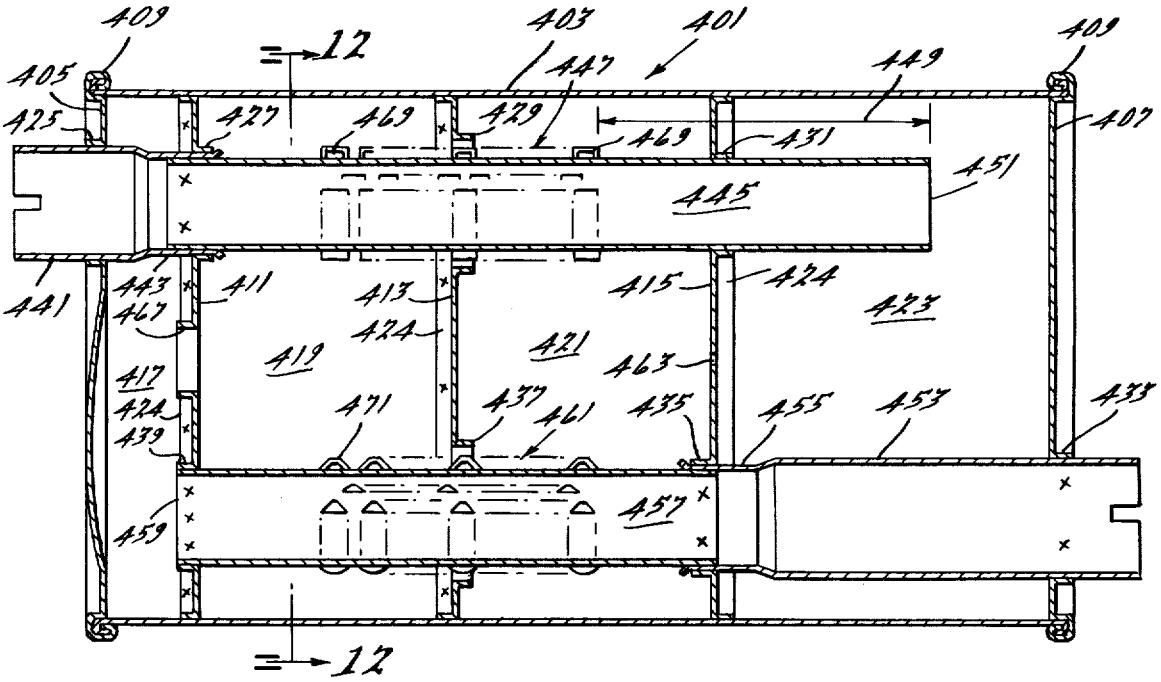
FIG. 10 is a view similar to FIG. 7 taken along line 10—10 of FIG. 11.
Figure 11:
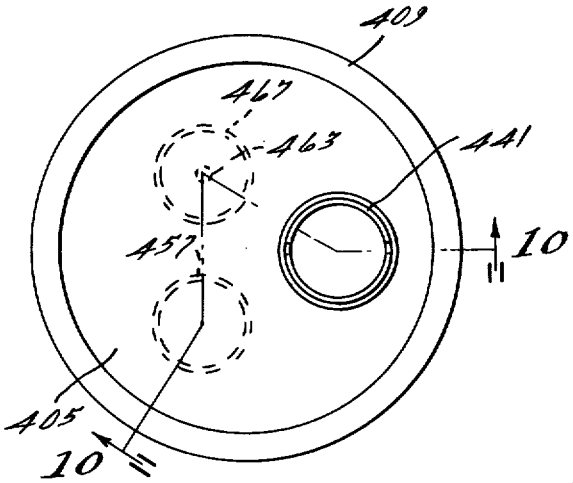
FIG. 11 is an end elevation taken from the left of FIG. 10.
Figure 12:
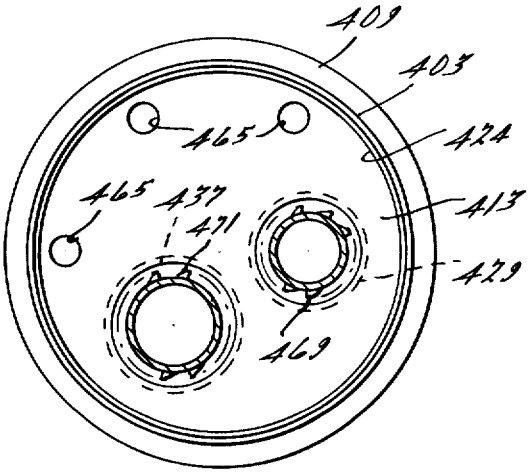
FIG. 12 is a cross section along the line 12—12 of FIG. 10.

Referring now to FIGS. 10–12, the muffler 401 is quite similar to muffler 301 and has a circular tubular shell 403, the ends of which are closed by an inlet header 405 and an outlet header 407, the headers being connected in a fluid tight joint with the ends of the shell 403 by the interlocks shown at 409. Within the shell 403 are a series of transversely extending axially spaced partitions 411, 413, and 415 which subdivide the shell into chambers 417, 419, 421, and 423 and have circumferential flanges 424 spotwelded to the shell.

The inlet header 405 has an outwardly extending collar 425 and this is coaxial with a collar 427 on the partition 411 and a collar 429 on the partition 413 and a collar 431 on the partition 415. The outlet header 407 has an outwardly extending collar 433 which is coaxially aligned with a collar 435 on the partition 415, a collar 437 on the partition 413, and a collar 439 on the partition 411.

An inlet bushing 441 is mounted in the collar 425 and spot-welded to it and has a reduced diameter portion 443 supported in collar 427 and spotwelded to it. An inlet gas flow tube 445 has its upstream end mounted in and spotwelded to the portion 443 of bushing 441. It has a louver patch 447 that extends through the collar 429 and an imperforate length designated by the arrowed line 449 that projects through the collar 431 and has its open end 451 in the chamber 423.

An outlet bushing 453 is supported in and spotwelded to the collar 433 in the header 407 and extends through chamber 423, being imperforate therein, and has a reduced diameter portion that is mounted in and spotwelded to the collar 435. The downstream end of an outlet tube 457 is mounted in and spotwelded to the reduced diameter portion 455 of the outlet bushing. The tube 457 has an open inlet or upstream end 459 which is mounted in and spotwelded to the collar 439. The tube 457 has a louver patch 461 extending through the collar 437.

The partition 415 has a very small opening or orifice 463 for the passage of gas between chambers 423 and 421. This orifice may, for example, be about ½" in diameter when the diameter of the shell 403 is about 6" so that only a small amount of gas (e.g. 5–15% of total flow) can pass through it. Thus, the chamber 423 in conjunction with the length 449 of tube 445 can serve as a Helmholtz resonator system, as discussed in connection with the previous embodiments, to attenuate a preselected low frequency and the function of the small hole 463 is to slightly broad band the tuning of the Helmholtz system and provide other advantages as previously discussed.

There are small clearances between the inner diameters of collars 429 and 437 and the outer diameters of the louver patches 447 and 461, respectively, through which some flow from chamber 421 to 419 can take place. The partition 413 has three openings 465 near its circumference which accommodate most of the flow between chambers 421 and 419, while the partition 411 has a collared opening 467 to provide for flow from chamber 419 into chamber 417. The louvers 469 in the louver patch 447 are preferably substantially rectangular as they open into the chamber 419 and their total open area is at least substantially 100% and preferably about 110% of the cross sectional area of the tube 445. On the other hand, the louvers 471 of the louver patch 461 are preferably semi-circular or trapezoidal at their inlet ends thereby imposing more resistance to flow since their individual area is less and their aggregate area is less than that of louver section 447, the two louver patches being about the same length. The partition 413 is preferably located at about the midpoint of the two louver patches.

In the arrangement illustrated, the tubes 445 and 457 are of about the same cross sectional area and the collared opening 467 is preferably about the same cross sectional area as the tubes. With this arrangement about 70–75% of the flow through the muffler passes through the opening 467 and into chamber 417 and then into the open end 459 of the outlet tube 457. The partition 413 acts as a flow splitter for gas forced out of patch 447 (at least 85% of total flow) whereby about half of it enters expansion chamber 421 and flows primarily through outwardly located holes 465 into expansion chamber 419 to thereby add more attenuation to sound in the intermediate frequency range.

As indicated, the muffler 401 is similar to muffler 301 but with the added function of orifice 463. The tendency to pressure build up in chamber 421 due to the orifice 463 is offset or balanced by openings 465 and to some extent by the clearances of collars 429 and 439 so that the desired back pressure and sound control is achieved. Muffler 401 may be used in many applications of a nature similar to those for muffler 301 but wherein additional control in the low frequency range is desired.

Figure 13:
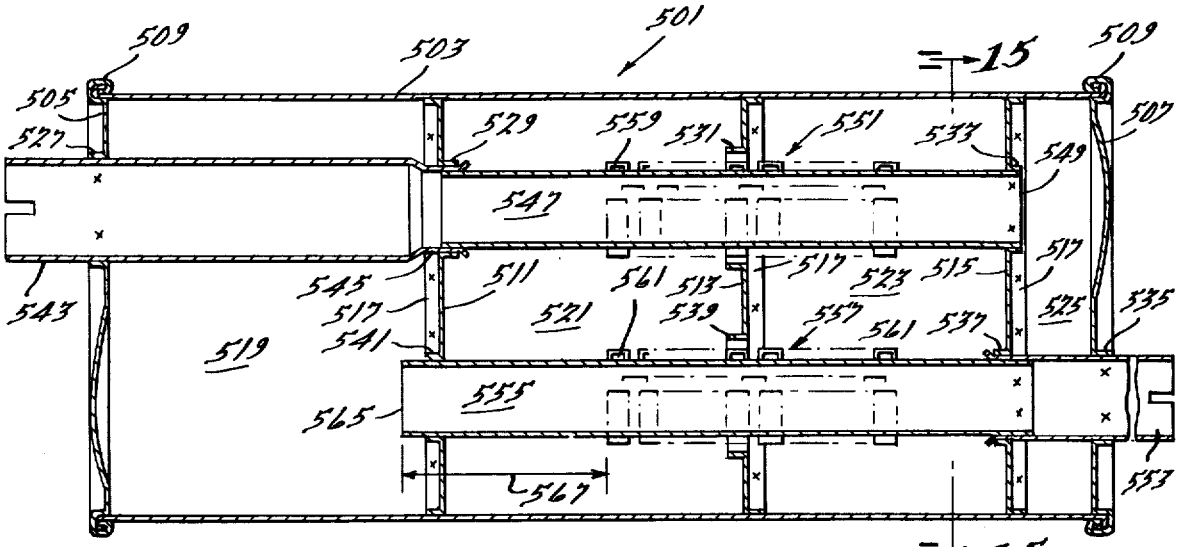
FIG. 13 is a cross section similar to that of FIG. 7 taken along the line 13—13 of FIG. 14.
Figure 14:
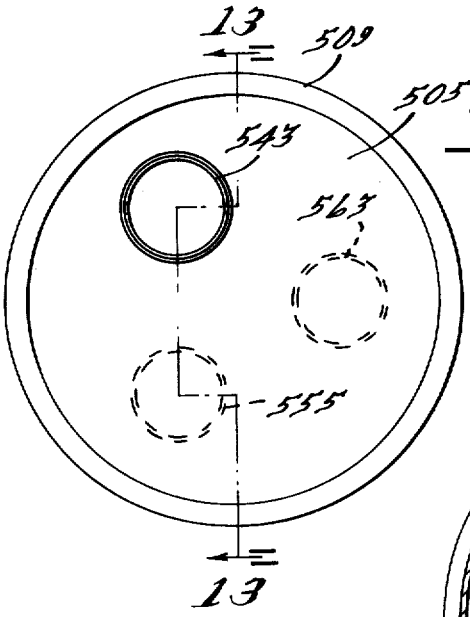
FIG. 14 is an end elevation taken from the left of FIG. 13.
Figure 15:
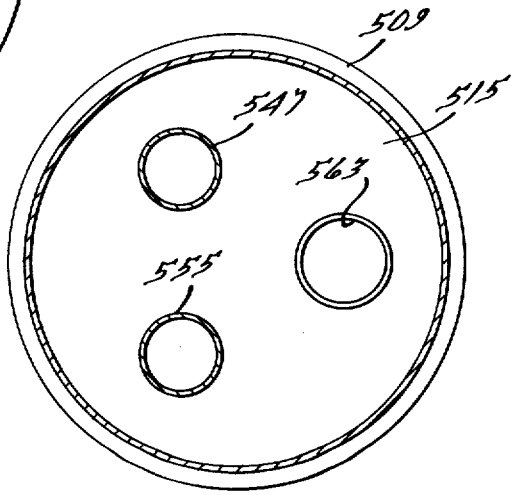
FIG. 15 is a cross section along the line 15—15 of FIG. 13.

Referring now to FIGS. 13–15 which shows the aspirating tuner referred to above, the muffler 501 has a tubular shell 503 of circular cross section which is closed at its inlet end by a header 505 and at its outlet end by a header 507, the headers being connected in fluid tight joints with the ends of the shell 503 as shown by the interlocks 509 to form a muffler housing. Within the shell 503 are three partitions 511, 513, and 515 which have circular circumferential outer flanges 517 that are spotwelded to the inside of the shell 503. As in the previous mufflers, the headers and partitions serve as transverse walls to subdivide the inside of the shell into end chamber 519, expansion chambers 521 and 523, and end chamber 525.

The inlet header 505 has an outwardly extending collar 527 which is coaxial with a collar 529 in the partition 511 and with a collar 531 in the partition 513 and with a collar 533 in the partition 515. The outlet header 507 has an outwardly extending collar 535 that is coaxial with a collar 537 in partition 515 and with collar 539 in partition 513 as well as with a collar 541 in partition 511. An inlet bushing 543 is mounted in and spotwelded to the collar 527 and has a reduced diameter inner portion 545 that is mounted in and spotwelded to the collar 529 in partition 511. The upstream end of an inlet tube 547 is supported in but preferably not spotwelded to the reduced diameter section 545. The tube 547 has an open downstream end as shown at 549 that opens into end chamber 525 and which is supported in and spotwelded to the collar 533. The inlet tube 547 has louver patch 551 which extends through the collar 531 in the partition 513.

An outlet bushing 553 is mounted in and spotwelded to the collar 535 in header 507 and has its inner end mounted in and spotwelded to the collar 537 of partition 515. An outlet tube 555 has its downstream end supported in and spotwelded to the inner end of the outlet bushing 553 while the other open end of the outlet tube 555 extends through the collar 541 for a short distance into the end chamber 519. The outlet tube 555 has a louver patch 557 that extends through the collar 539 in partition 513.

Preferably the louver patches 551 and 557 are of about the same length and the splitter partition 513 is preferably located about midway along the length of the louver patches. In this particular embodiment, the louvers 551 and 557 in the two tubes are preferably the same in cross sectional shape and this is preferably rectangular as illustrated. The total cross sectional area of all the louvers 559 in the patch 551 is preferably about 100–110% of the cross sectional area of tube 547 and the total cross sectional area of all the louvers 551 in the louver patch 557 is preferably about 100–110% of the cross sectional area of the tube 555. In this arrangement, the outlet tube 555 is preferably slightly larger in diameter than the inlet tube 547. Since the louvers in the two patches are of the same shape and the area of patch 557 is actually a little larger than the open area of patch 551 because the tube 555 is somewhat larger than the tube 547, the patch 557 will not present the same degree of resistance to inflow of gas entering the outlet tube as in the preceding embodiments.

The partition 515 has a collared opening 563 which is preferably about the same in area as the outlet tube. Gas in the inlet tube can therefore flow into end chamber 525 and then through collar 563 into expansion chamber 523. There is some cross flow from the inlet tube out of its louver patch 551 into chambers 521 and 523 and about 25–30% of the flow entering outlet tube 555 does so through that portion of the patch in expansion chamber 521. The splitter partition 513 acts to baffle the flow out of collar 563 to force it out louver patch 557 in chamber 523 as well as splits the cross flow from the inlet patch 551 and mixes that part of it entering chamber 523 with the flow from collar 563. About 70–75% of the flow enters the outlet tube from chamber 523. The clearances between collars 531 and 539 and the louvers 559 and 561, respectively, provide spaces for some flow between chambers 523 and 521, primarily from chamber 523 to 521, which tends to balance the pressure between the chambers. It is noted that the partition 531 adds significant structural strength to the housing 503.

The portion of the inlet bushing 543 within the chamber 519 is imperforate as is partition 511 so that end chamber 519 is a resonator chamber whose only inlet and outlet are the open end 565 of the outlet tube 555. It can then act in conjunction with the imperforate portion of tube 555, designated by the arrowed line 567, between the adjacent end of the louver patch 557 and the open end 565 of the tube, the section 567 acting as a tuning tube so that its length and inner diameter and the volume of the chamber 519 may be interrelated and made interdependent in accordance with the Helmholtz formula set forth above to form a Helmholtz system that will attenuate a selected low frequency.

Since the gas flow is directed from inlet tube 547 through the louver patch 557 which is located downstream of the tuning tube, the resonator system is of the aspirating type. Such a system functions more effectively when there is considerable length of exhaust system conduit located on the downstream side of the muffler, i.e., connected to outlet bushing 553. Consequently, this muffler is most effectively used if it is located ahead of the over the axle kick-up in the exhaust system. As will all mufflers using the Helmholtz attenuating system, the muffler is preferably located as close as possible to a pressure antinode of the preselected frequency to be attenuated.

The particular muffler 501 has somewhat larger tubes than the previous mufflers and is designated for a specific pick-up truck whereas the others were designed for specific passenger automobiles.

The various embodiments have revealed how a pair of louver or perforated tubes each terminating in an end chamber formed by transverse walls in a muffler housing and having louver or perforate patches opening into an intermediate expansion chamber or chambers, wherein one of the end chambers acts as a resonator and serves to force substantially full flow through the louver patch of the tube opening therein, can be used to attenuate substantially the whole spectrum of intermediate and high frequency exhaust gas sound generated by the engine and by "air rush" and can also be used to tune out a preselected note in the low frequency range. Modifications in this basic structure, such as the differing louver arrangements, the small outlet orifice for the resonator chamber, and the splitter partition have also been described but further modifications are within the spirit and scope of the invention.

We claim:

1. An acoustic muffler for attenuating sound in flowing gas such as the exhaust gas from a combustion engine comprising a housing having an inlet and an outlet, an elongated substantially straight inlet tube member in said housing having an inlet opening at one end arranged to receive substantially all gas entering the muffler, said tube member having a side wall with a perforated section therein, said perforated section comprising the gas outlet for said tube member and having a multiplicity of openings therein with a total open area for the flow of gas out of the tube member which is equal to at least substantially 100% of the cross sectional area of the section, the outlet flow of gas from said tube member through said gas outlet being in a direction transverse to the inlet flow and to the length of the tube member, means cooperating with said tube member to force substantially all gas entering the tube member to leave the tube member by flowing through said gas outlet perforated section, walls connected to said housing forming an expansion chamber means containing the entire gas outlet perforated section of the tube member whereby all gas flowing out of the perforated section enters said expansion chamber means, an elongated outlet tube member arranged to receive all gas entering the muffler and deliver it to said muffler outlet, said outlet tube member having an open inlet end and having a wall with a perforated section therein, said outlet tube member perforated section being totally contained in said expansion chamber means and comprising a multiplicity of in-flow gas openings therein that are individually smaller in open area than the openings in the perforated section of the inlet tube member to thereby present a substantial resistance to cross flow from the inlet tube member through the expansion chamber means and into the outlet tube member through the perforated section in the outlet tube member, said housing walls forming a chamber into which the open inlet end of the outlet tube opens to receive gas flow from said chamber, and means for the passage of gas from said expansion chamber means into said chamber.

2. An acoustic muffler for sound attenuation of flowing gas such as the exhaust gas of a combustion engine comprising an elongated tubular housing having transverse inlet and outlet end walls and transverse internal walls subdividing the housing into a series of transverse chambers axially separated from each other, said housing having an inlet in said inlet wall and an outlet in said outlet wall, a longitudinally extending outlet gas flow tube member open at each end and supported on said walls and delivering gas to said outlet at one end, the other end of said outlet tube member opening into a first one of said chambers and said first chamber being otherwise substantially closed except for said tube member opening into it whereby said tube member serves as substantially the only port for the flow of gas into and out of said first chamber, a longitudinally extending inlet gas flow tube member open at each end supported on said walls and having an open end in a second of said chambers, a third of said chambers being located between the first and second chambers and having communication with the second chamber of sufficient size to provide for the flow of a major part of the gas flowing through the muffler, a fourth of said chambers being located between the first and third of said chambers, each of said tube members having a perforated section through the wall thereof located in and opening into both said third and fourth chambers, the perforated section in said outlet tube member having a multiplicity of openings of sufficient size so that their total open area provides for flow into the outlet tube of substantially all gas flowing through the muffler.

3. A muffler as set forth in claim 2 wherein said outlet tube member has an imperforate portion between its perforated section and the end opening into the first chamber, the length and diameter of the imperforate section and the volume of the first chamber being interrelated in accordance with the Helmholtz formula to provide a Helmholtz resonator system for attenuating a preselected low frequency of sound.

4. An acoustic muffler for sound attenuation of flowing gas such as the exhaust gas of a combustion engine comprising an elongated tubular housing having transverse inlet and outlet end walls and transverse internal walls subdividing the housing into a series of transverse chambers each extending across the width of the housing, there being a first end chamber adjacent the inlet end wall of the housing and a second end chamber adjacent the outlet end wall of the housing, there being transverse chamber means between said first and second end chambers for gas flow and expansion, said housing having an inlet in said inlet end wall and an outlet in the outlet end wall, a longitudinally extending substantially straight inlet gas flow tube member supported on said walls and receiving gas from said inlet and having an open end terminating in said second end chamber, a longitudinally extending substantially straight outlet gas flow tube member supported on said walls and having an open end terminating in said first end chamber, said second end chamber being substantially closed to gas flow except for the inlet tube member opening therein, the first of said end chambers having gas flow communication with said transverse chamber means by means of at least one opening formed in that transverse wall which acts with the inlet end wall to form said first end chamber, each of said tube members having a perforated gas flow through section located in said transverse chamber means and each said section comprising a multiplicity of openings in the side wall of the tube member so that gas passing through the openings flows transversely to the length of the tube member, the perforated section in the inlet tube member that opens into said closed second end chamber constituting the outlet for gas leaving the inlet tube member whereby substantially all gas entering the muffler must change direction of flow within the tube member from parallel to the length of the tube to substantially perpendicular thereto in order to flow out of the tube member into said transverse chamber means.

5. A muffler as set forth in claim 4 wherein the perforated section in the inlet tube member is longitudinally spaced from the end of said tube member opening into said closed second end chamber and the inlet tube member portion between said perforated section and said open end acts with said closed chamber as a tuning tube to attenuate a predetermined low frequency of sound.

6. A muffler as set forth in claim 5 wherein the transverse wall acting with the outlet end wall to form said substantially closed second end chamber has an orifice therethrough connecting the closed chamber to the transverse chamber means and capable of passing no more than about 15% of the gas flowing through the muffler.

7. A muffler as set forth in claim 4 wherein said housing is oval in cross section and has an additional transverse wall in said second end chamber that is provided with a large open area for free communication between opposite sides of the wall whereby said additional wall serves an a structural member to strengthen the oval housing in the region of the second end chamber.

8. A muffler as set forth in claim 4 including a transverse flow splitter partition in said housing in said transverse expansion chamber means and intermediate the ends of the perforated section of the inlet tube member and having an opening therein through which said tube member extends, said splitter partition dividing said expansion chamber means into two separate expansion chambers, the perforated section in the inlet tube member opening into both of said two separate chambers.

9. A muffler as set forth in claim 8 wherein the transverse flow splitter partition is also located intermediate the ends of the perforated section in the outlet tube member so that the perforated sections of both tube members open into both of said two separate expansion chambers.

10. A muffler as set forth in claim 8 wherein said transverse partition has openings therethrough to provide for gas flow from one of said two separate chambers to the other, said openings being located in a portion of the partition spaced radially away from and separate from the opening through which the perforated section of said inlet tube member extends.

11. A muffler as set forth in claim 9 wherein the perforated section in the inlet tube member comprises a multiplicity of openings having a total open area for the flow of gas out of the section which is equal to at least substantially 100% of the cross sectional area of the section, the perforated section in the outlet tube member comprising a multiplicity of openings therein that are individually smaller in open area than the openings in the perforated section of the inlet tube member to thereby present a substantial resistance to cross flow from the inlet tube member through the expansion chamber means and into the outlet tube member through the perforated section in the outlet tube member.

12. A muffler as set forth in claim 4 wherein the inlet tube member has an imperforate section at the end thereof opening into said closed second end chamber and acting with said chamber as a tuning tube to attenuate a predetermined low frequency of sound, the transverse wall acting with the outlet end wall to form said second end chamber having an orifice therein longitudinally aligned with said opening in the other transverse wall, said orifice connecting the closed chamber to the transverse chamber means and being sized to pass about 5–15% of the gas flowing through the muffler.

13. A muffler as set forth in claim 4 wherein the perforated section in the inlet tube member is longitudinally spaced from the end of said tube member opening into said closed second end chamber and the tube member portion between said perforated section and said open end acts with said closed chamber as a tuning tube to attenuate a predetermined low frequency of sound, the transverse wall acting with the outlet end wall to form said substantially closed end chamber having an orifice therethrough connecting the closed second chamber to the transverse chamber means and capable of passing no more than about 15% of the gas flowing through the muffler, a transverse partition in said housing in said expansion chamber means and intermediate the ends of the perforated section of the inlet tube member and dividing said expansion chamber means into two separate expansion chambers, said inlet tube perforated section opening into both of said two separate chambers.

14. A muffler as set forth in claim 13 wherein the transverse partition is also located intermediate the ends of the perforated section in the other of the tube members so that the perforated section of each of the tube members opens into both of said two expansion chambers.

15. A muffler as set forth in claim 13 wherein said transverse partition has openings therethrough for the inlet tube member and to provide for gas flow from one of said two separate chambers to the other, said gas openings being located in a portion of the partition spaced radially away from and separate from the opening through which the perforated section of the tube member extends.

16. A muffler as set forth in claim 13 wherein the perforated section in the inlet tube member comprises a multiplicity of openings having a total open area for the flow of gas out of the section which is equal to at least substantially 100% of the cross sectional area of the section, the perforated section in the outlet tube member comprising a multiplicity of openings therein that are individually smaller in open area than the openings in the perforated section of the inlet tube member to thereby present a substantial resistance to cross flow from the inlet tube member through the expansion chamber means and into the outlet tube member through the perforated section in the outlet tube member.

17. An acoustic muffler for sound attenuation of flowing gas such as the exhaust gas of a combustion engine comprising an elongated tubular housing having transverse inlet and outlet end walls and transverse internal walls subdividing the housing into first and second transverse end chambers axially separated from each other and a central chamber space between the end chambers, said housing having an inlet in said inlet wall and an outlet in said outlet wall, a longitudinally extending inlet gas flow tube member open at each end and supported on said walls and receiving gas from said inlet at one end, the other end of said second end chamber being otherwise substantially closed except for said inlet tube member opening into it whereby said inlet tube member serves as substantially the only port for the flow of gas into and out of said second end chamber and said second end chamber is substantially impervious to gas flow through it, a longitudinally extending outlet gas flow tube member open at each end supported on said walls and having an open end in said first end chamber, a transverse splitter partition extending across said housing in the central chamber space between the first and second end chambers and having apertures therein of sufficient size so that said inlet tube member and said outlet tube member can extend through the partition and having gas flow openings therein, said tube members extending through said partition and each having a perforated section in the wall thereof for the flow of gas through the wall at substantially right angles to the length of the tube member, said perforated sections being located entirely in said central chamber space and each having a portion thereof on opposite sides of said partition, the perforated section in said inlet tube member having a multiplicity of openings of sufficient size so that the total open area thereof provides for flow of substantially all gas entering the inlet tube member out of its perforated section into the central chamber space whereby said perforated section provides for outlet flow from the inlet tube member of substantially all gas entering the muffler at substantially right angles to the direction of gas flow as it enters the inlet of the muffler, the perforated section of the outlet tube member having a multiplicity of openings of substantially smaller size than those in the inlet tube member and having a substantially less total open area so that a substantial portion of but not all gas entering the housing space from the inlet tube member flows into the first end chamber to enter the open end of the outlet tube member.

18. A muffler as set forth in claim 17 wherein said two end chambers and said central chamber space extend across the full transverse width of the housing and occupy substantially the entire volume of said housing.

19. A muffler as set forth in claim 17 wherein said inlet tube has a imperforate length between said perforated section and the end opening into said end chamber, the length and diameter of said imperforate section and the volume of said second end chamber being interrelated in accordance with the Helmholtz formula to provide a Helmholtz resonator system for attenuating a preselected low sound frequency, means providing gas flow communication between the second end chamber and central chamber space of very small size and capable of providing passage for no more than about 15% of the gas flow through the muffler.

20. A muffler as set forth in claim 7 wherein communication between the central chamber space and first end chamber is provided by a collared opening in the transverse wall between them.

21. A muffler as set forth in claim 17 wherein communication between the central chamber space and first end chamber is provided by a series of spaced openings in the transverse wall between them.

22. A muffler as set forth in claim 17 wherein the openings in the inlet tube member are in the form of louvers having substantially rectangular cross sectional shape and the openings in the outlet tube member are in the form of louvers having substantially trapezoidal cross sectional shape.

23. A muffler as set forth in claim 17 wherein said transverse splitter partition has gas flow openings through it adjacent an outer radial portion of the wall to provide for flow from all parts of the central chamber space to the first chamber.

24. A muffler as set forth in claim 23 wherein the perforated sections in the tube members are approximately of equal length and coextensive and said splitter partition is located at approximately the midpoints of the lengths of said perforated sections.

25. A muffler as set forth in claim 23 wherein the perforated section in the outlet tube member is substantially longer than the perforated section in the inlet tube member.

26. A muffler as set forth in claim 25 wherein the lengths of the perforated sections of the two tube members on one side of the splitter partition are substantially equal.

27. A muffler as set forth in claim 17 wherein the cross sectional shape of the housing is round.

28. A muffler as set forth in claim 17 wherein the cross sectional shape of the housing is oval.

29. A muffler as set forth in claim 23 wherein the transverse wall for said second end chamber has a small centrally located opening through it capable of passing no more than about 15% of the gas flow through the muffler.

* * * * *